US006003190A

United States Patent [19]

Knudsen

[11] Patent Number: 6,003,190

[45] Date of Patent: Dec. 21, 1999

[54] CLEANING PAD FOR MOUNTING ON THE LEG OF A GOLF PLAYER

[76] Inventor: Clifford T. Knudsen, Box 92 Rock Hill Rd., High Falls, N.Y. 12440

[21] Appl. No.: 09/089,631

[22] Filed: Jun. 3, 1998

[51] Int. Cl.[6] ..... A47L 13/16

[52] U.S. Cl. ..... 15/210.1; 15/244.3; 15/160; 15/227; 2/227

[58] Field of Search ..... 15/209.1, 210.1, 15/160, 222, 227, 244.3, 208; 2/227, 69, 115

[56] References Cited

U.S. PATENT DOCUMENTS

| | | | |
|---|---|---|---|
| D. 267,751 | 1/1983 | Dobyns | D32/1 |
| D. 275,780 | 10/1984 | Pearson | D21/795 |
| D. 308,766 | 6/1990 | Van Rensburg | D4/119 |
| D. 317,693 | 6/1991 | Jencks et al. | D6/608 |
| D. 339,496 | 9/1993 | Corcoran | D6/608 |
| D. 350,630 | 9/1994 | Smith | D32/1 |
| D. 386,847 | 11/1997 | Petrie | D32/35 |
| 1,293,700 | 2/1919 | Carlson | 2/231 |
| 1,816,108 | 7/1931 | Blumenfeld | 15/209.1 |
| 3,648,315 | 3/1972 | Hash | 15/4 |
| 3,661,690 | 5/1972 | Taranto | 15/227 |
| 4,457,640 | 7/1984 | Anderson | 15/227 |
| 4,516,616 | 5/1985 | Fesler | 150/154 |
| 4,823,426 | 4/1989 | Bragga | 15/210.1 |
| 4,912,800 | 4/1990 | Zeltner | 15/114 |
| 4,940,349 | 7/1990 | van Rensburg | 401/10 |
| 5,054,153 | 10/1991 | Silliman | 15/160 |
| 5,147,703 | 9/1992 | Provost et al. | 428/82 |
| 5,177,881 | 1/1993 | Moore | 34/239 |
| 5,195,743 | 3/1993 | Walsh, Jr. | 473/401 |
| 5,331,705 | 7/1994 | Melov | 15/118 |
| 5,385,160 | 1/1995 | Brinuman | 134/186 |
| 5,404,610 | 4/1995 | Coyer, Sr. et al. | 15/104.92 |
| 5,560,066 | 10/1996 | McDivitt | 15/88.3 |
| 5,666,684 | 9/1997 | Cussen | 15/104.92 |
| 5,671,498 | 9/1997 | Martin et al. | 15/222 |
| 5,724,698 | 3/1998 | Mondragon | 15/210.1 |
| 5,765,233 | 6/1998 | Hayes | 2/227 |
| 5,809,669 | 9/1998 | Hage et al. | 15/227 |
| 5,863,190 | 4/1999 | Mertz | 15/210.1 |

FOREIGN PATENT DOCUMENTS

| | | | |
|---|---|---|---|
| 2277273 | 10/1994 | United Kingdom | 15/210.1 |

*Primary Examiner*—Mark Spisich
*Assistant Examiner*—Theresa T. Snider

[57] ABSTRACT

A cleaning pad for golf players for mounting on the leg of the player above the ankle for cleaning the head of a club and having a base layer of absorbent material against the player, a vapor barrier of the outside the base layer, a cushion layer on the outside the vapor barrier and an exterior layer on which the club head can be readily wiped on the outside of the cushion layer. Straps with hook and loop material hold the pad on the leg of the person playing golf. The exterior layer is preferably terry cloth and one alternate embodiment uses an exterior layer of felt and still another alternate embodiment uses an exterior layer of terry cloth but with bristles mounted in the cushion layer extending through the terry cloth.

15 Claims, 3 Drawing Sheets

CLEANING PAD FOR MOUNTING ON THE LEG OF A GOLF PLAYER

BACKGROUND OF THE INVENTION

1. Field of the Invention

This invention relates to cleaning pads and more specifically to a cleaning pad that can be easily mounted on the leg of a golf player and used to clean the head of a golf club while playing.

2. Prior Art and Objects of the Invention

When playing golf, the head of the golf club frequently becomes dirty requiring that it be cleaned. Having a towel or other device readily available, is not easily achieved. To maintain a golf course, various chemicals such as weed killer and fertilizer are applied which contaminate the head of the golf club. Towels similar in appearance to small hand towels are carried by golfers. The towels that are carried are generally used for the player's hands and if left on a golf bag or in a golf cart may not be readily available to the player. It has been common place for golfers to wipe the head of the club on their clothing, most usually on the leg of their slacks, or in the case of a putter in particular, to wipe the club off with their finger or hand and then wipe off their hand on their clothing.

Towels have been long used in the game of golf and such towels, which are most usually terry cloth towels, serve a wide variety of purposes. Golfers need to maintain dry hands to grip the club. When the head of the club becomes dirty, thus requiring cleaning, to use the same towel as used for the hands is not desirable in view of the amount of dirt often removed from the head of a golf club. If the towel is not readily available thus requiring the player to interrupt playing to obtain the towel, there is a decided chance that the player, as stated above, will resort to using his or her clothing to solve the problem of a dirty head on a golf club. Since frequent cleaning is important, to place the cleaning pad where it can be quickly and frequently used with minimal movement and no discernible interruption of the golf game, is very beneficial.

This invention provides a cleaning pad for cleaning the head of a golf club which cleaning pad is comfortable and conveniently worn by the player on the player's leg just above the ankle so as always to available to the player as needed.

Accordingly, it is an object of the present invention to provide a cleaning pad for the head of a golf club which efficiently and conveniently permits cleaning while playing.

It is another object of the invention to provide a cleaning pad for the head of a golf club that is economical and reusable.

It is another object of the invention to provide a cleaning pad that can be comfortably worn on the leg of the player.

Other objects and advantages of the present invention will become apparent of those of ordinary skill in the art as the description thereof proceeds.

SUMMARY OF THE INVENTION

A cleaning pad is provided that mounts easily and comfortably on the leg of a golf player preferably just above the ankle. The cleaning pad includes a pad which is sized to cover the front part of the leg and bend about the sides of the leg. The pad includes a base layer of absorbent cloth which presses against the player. A vapor barrier is then affixed to the base layer. A cushion layer which is soft and absorbent, such as a sponge-like material, is mounted on the vapor barrier. An exterior layer of absorbent cloth is mounted on the absorbent layer.

DESCRIPTION OF THE PREFERRED EMBODIMENT

Figure 1:
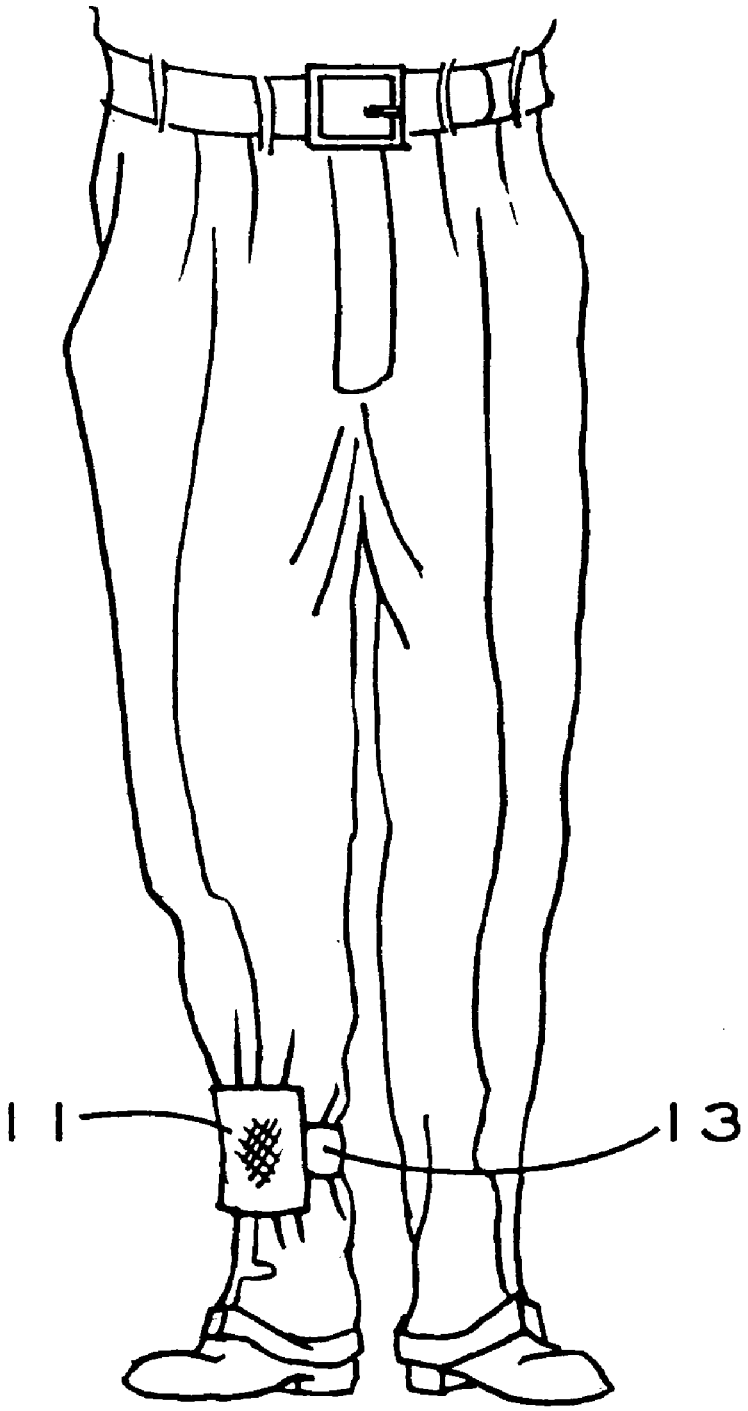
FIG. 1 is a pictorial view of the cleaning pad mounted on the leg of a player.
Figure 2:
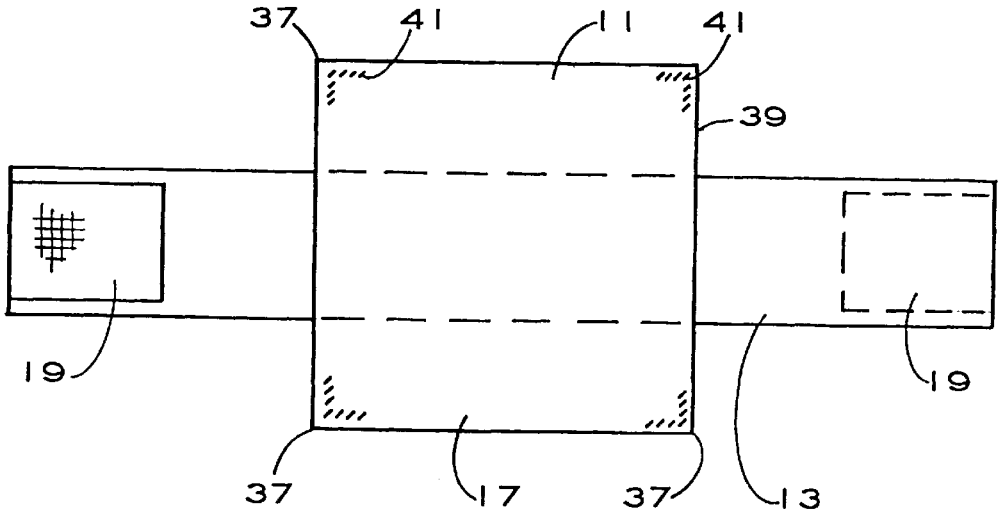
FIG. 2 is a plan view of the cleaning pad looking down on the exterior layer.

Referring now to the drawings and more particularly to FIG. 1, a cleaning pad is shown including a pad 11 with a strap 13 wrapped about the leg of one playing golf. The strap 13 must be flexible and absorbent so as to be comfortable when worn on the leg of a golf player. Since some golf players wear slacks, in such cases, the cleaning pad will be worn over the slacks. When shorts are worn, the cleaning pad may be worn over socks or on the skin of the player. The pad 11 has multiple layers, with the strap 13 affixed to the underside of the pad 11. The pad 11 has an inside surface 15 which is against the player or the clothing of the player and an outside surface 17 which is used for cleaning the head of a golf club. As best seen in FIG. 2, fastening means 19 are located at the ends of the strap 13, the preferable form of fastening means 19 being hook and loop material since it permits a wide variety of adjustment of the length of the strap 13 about the leg thus providing the greatest possible comfort to the player.

Figure 3:
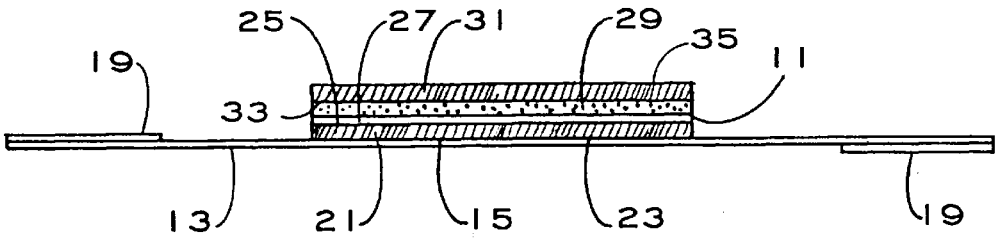
FIG. 3 is a side view of the basic embodiment as used in a game of golf.

Referring now to FIG. 3, the multi-layers used to construct the pad 11 of the cleaning pad are shown. The inside surface 15 of the pad 11 is against the wearer. A base layer 21, whose inside surface 23 forms the inside surface 15 of the pad 11, presses against the wearer. The base layer 21, which also has an outside surface 25, must be flexible to bend about the leg and be soft and moisture absorbent to provide comfort to the wearer. One suitable material for the base layer 21 is terry cloth which is flexible and comfortable to the wearer. The strap, as seen in FIG. 2, is on the inside surface 15 of pad 11 but may be placed elsewhere, as for example, on the outside surface 25 of the base layer 21.

Against the outside surface 25 of the base layer 21, a vapor barrier 27 is mounted. As with all of the multiple layers of the pad 11, it is essential that the vapor barrier 27 be flexible. A plastic sheet is suitable as the vapor barrier 27. The vapor barrier 27 is intended to prevent liquids, especially liquids with dirt in it, from a golf club from permeating the base layer 21 and the garment of the wearer. On the other side of the vapor barrier 27 from the base layer 21, a cushion layer 29 is located. The cushion layer 29 must also be flexible and be exceptionally soft such as a foam rubber or other sponge-like material but must be flexible both when dry and when wet. The cushion layer 29 provides the ability of the pad 11 to depress and generally conform to the shape of the surface of the head of a golf club.

On the side of the cushion layer 29, opposite from the vapor barrier 27, an exterior layer 31 is located. The exterior layer 31 has an inside surface 33 against the cushion layer 29 and also has an outside surface 35. The outside surface 35 is co-extensive with the outside surface 17 of the pad 11.

Again, flexibility is essential for the exterior layer 31. Absorbency is also essential for the exterior layer 31 and an exterior layer 31 which has good cleaning action and is still non abrasive is important. Once again, terry cloth is a very viable material for the exterior layer 31.

The multi-layers can be held together in a variety of ways. It is important that the multiple layers of the pad 11 not be bound to one another over their entire surface as this would prevent proper cleaning between the multiple layers when the cleaning pad is washed. Adhesives are likely to prevent the flexibility desired and would be a deterrent to proper cleaning. Metallic fasteners are not acceptable as they would scratch the surface of the head of the golf club. The pad 11 can have a variety of shapes but rectangular or square are the most easily produced. It is preferable therefor to stitch the multiple layers together at the corners 37 (as best seen in FIG. 2) generally along the edges 39 of the multiple layer with a soft thread 41 that will not be unduly abrasive. The same concept can be achieved with pads 11 of other configurations and an oval pad (not shown) would be held together with four groups of stitches of soft thread 41.

Figure 4:
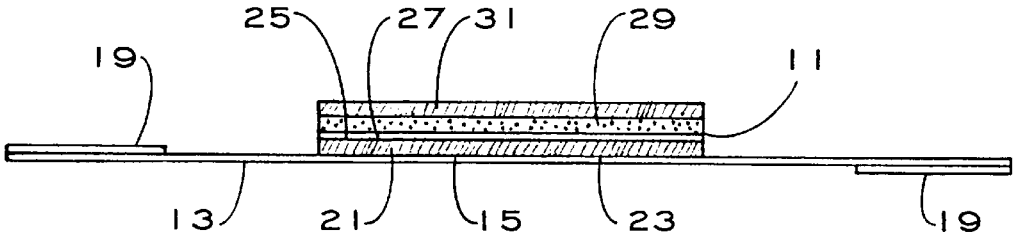
FIG. 4 is a side view of an alternate embodiment for use when putting.

In FIG. 4, an alternate embodiment is shown that is a slight modification over the embodiment of FIG. 3. The strap with fastening means, vapor barrier and cushioning layer are located in the same relationship to one another. In place of an exterior layer 31 of terry cloth, felt is used. This is particularly intended for use with putting irons since the felt is especially effective on such a small and smooth iron and with the type of foreign matter that accumulates on a putting iron.

Figure 5:
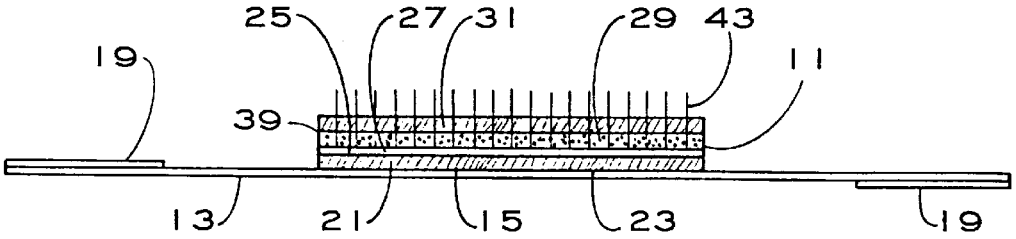
FIG. 5 is a side view of an alternate embodiment for use when in a sand trap.

FIG. 5 is also similar to the basic design shown in FIG. 3 but includes bristles 43 extending through the exterior or outside surface 35 and imbedded in the cushion layer 29. This embodiment is most useful when using the golf club in a sand trap. The sand particles become embedded in grooves in the head of the golf club and the bristles 43 are most effective to remove the sand from the grooves.

A player can use whichever cleaning pad is best and, if need be can place different versions on each leg. Most of the time the embodiment of FIG. 3 will be used. The location of the cleaning pad just above the ankle permits easy stroking of the head of the golf club over the cleaning pad with limited movement of the club from the ground.

Thus, while preferred embodiments of the invention has been shown and disclosed, it will be apparent to those skilled in the art that many other changes and modifications may be made without departure from the invention in its broader aspects. The appended claims are therefore intended to cover all such changes, and modifications as being fully within the true spirit and scope of the invention.

I claim:

1. A cleaning pad for mounting on the leg of a golf player to clean the head of a golf club, the cleaning pad comprising:

a pad of multiple layers that are flexible, including;

a base layer having an inside surface and an outside surface, the base layer being absorbent, a vapor barrier that is impervious to moisture secured against the outside surface of the base layer;

a cushion layer having an inside surface and an outside surface, the inside surface of the cushion layer being secured on the vapor barrier, the cushion layer being flexible, soft and absorbent, an exterior layer mounted on the outside surface of the cushioning layer, the outside layer being flexible and absorbent; and strap means secured to the pad for mounting the pad.

2. A cleaning pad according to claim 1 wherein the pad has a rectangular shape.

3. A cleaning pad according to claim 1 wherein the multiple layers of the pad are secured together by stitching in four spaced positions.

4. A cleaning pad according to claim 1 wherein the base layer is terry cloth.

5. A cleaning pad according to claim 1 wherein the cushion layer is a sponge-like material.

6. A cleaning pad according to claim 1 wherein the exterior layer is terry cloth.

7. A cleaning pad according to claim 1 wherein the exterior layer is felt.

8. A cleaning pad according to claim 1 wherein the exterior layer is terry cloth and further including bristles mounted in the cushion layer and extending through the exterior layer.

9. A cleaning pad for mounting on the leg of a golf player to clean the head of a golf club, the cleaning pad comprising:

a base layer of terry cloth having an inside surface and an outside surface, the base layer being flexible and absorbent;

a vapor barrier of plastic that is flexible and generally impervious to moisture against the outside of the base layer;

a cushion layer having an inside surface and an outside surface, the inside surface of the of the cushioning layer being mounted on the vapor barrier, the cushioning layer being flexible, soft and absorbent;

an outside layer of terry cloth mounted on the outside surface of the cushioning layer, the outside layer being flexible and absorbent; and mounting means secured to the base layer, the base layer, vapor barrier, cushioning layer and outside layer having substantially the same size and configuration and being secured together by a few generally equally spaced groups of stitching.

10. A cleaning pad according to claim 9 wherein the cushion layer is a sponge-like material.

11. A cleaning pad according to claim 10 wherein the pad has a rectangular shape.

12. A cleaning pad for mounting on the leg of a golf player to clean the head of a golf club, the cleaning pad comprising:

a pad having a rectangular configuration of multiple layers that are flexible including;

a base layer of terry cloth having an inside surface and an outside surface, a vapor barrier of plastic that is impervious to moisture secured to the outside surface of the base layer, a cushion layer of foam rubber that is soft and absorbent having an inside surface and an outside surface, the inside surface of the cushion layer being secured to the vapor barrier, an exterior layer of absorbent cloth secured to the outside surface of the cushion layer, stitching in the corners of the pad to secure the multiple layers together; and strap means with an inside surface and an outside surface secured to the pad for mounting the pad, the strap means having a strap with two ends, hook and loop material being secured to the strap at one of the two ends on the inside surface and at the other of the two ends on the outside surface.

13. A cleaning pad according to claim 12 wherein the exterior layer of absorbent cloth is terry cloth.

14. A cleaning pad according to claim 12 wherein the exterior layer of absorbent cloth is felt.

15. A cleaning pad according to claim 12 wherein the exterior layer of absorbent cloth is terry cloth and further including bristles mounted in the cushion layer and extending through the exterior layer.

* * * * *